US008513883B2

(12) United States Patent
Radivojevic et al.

(10) Patent No.: US 8,513,883 B2
(45) Date of Patent: Aug. 20, 2013

(54) ELECTROLUMINESCENT DEVICE HAVING PIEZOELECTRIC COMPONENT

(75) Inventors: Zoran Radivojevic, Cambridge (GB); Richard White, Cambridge (GB); Alan Colli, Cambridge (GB); Di Wei, Cambridge (GB); Piers Andrew, Cambridge (GB)

(73) Assignee: Nokia Corporation, Espoo (FI)

( * ) Notice: Subject to any disclaimer, the term of this patent is extended or adjusted under 35 U.S.C. 154(b) by 305 days.

(21) Appl. No.: 12/347,209

(22) Filed: Dec. 31, 2008

(65) Prior Publication Data

US 2010/0164378 A1 Jul. 1, 2010

(51) Int. Cl.
*H05B 33/02* (2006.01)

(52) U.S. Cl.
USPC ..... 313/508; 310/311; 428/690

(58) Field of Classification Search
USPC ..... 310/311; 313/506, 508; 345/170; 428/690
See application file for complete search history.

(56) References Cited

U.S. PATENT DOCUMENTS

| | | | | |
|---|---|---|---|---|
| 3,290,549 | A * | 12/1966 | Lambe et al. | 315/55 |
| 4,991,150 | A | 2/1991 | Wixom | |
| 5,446,334 | A * | 8/1995 | Gaffney | 310/338 |
| 2008/0067618 | A1 | 3/2008 | Wang et al. | |

FOREIGN PATENT DOCUMENTS

| | | | |
|---|---|---|---|
| EP | 1009033A2 | A2 | 6/2000 |
| JP | 11120801 | A | 4/1999 |
| JP | 2002-063801 | A | 2/2002 |
| JP | 2003-253261 | A | 9/2003 |

OTHER PUBLICATIONS

International Search Report and Written Opinion received for corresponding Patent Cooperation Treaty Application No. PCT/FI2009/050762, dated Dec. 29, 2009, 12 pages.

Vayssieres, "Growth of Arrayed Nanorods and Nanowires of ZnO from Aqueous Solutions", Advanced Materials, vol. 15, No. 5, Mar. 7, 2003, pp. 464-466.

Wang, et al., "Piezoelectric Nanogenerators Based on Zinc Oxide Nanowire Arrays", Science, Reports, vol. 312, Apr. 14, 2006, pp. 242-246.

Satoh, et al., "Low operation voltage in AC type inorganic electroluminescence devices using ZnO nanorods layer", Proceedings of the 9th Asian Symposium on Information Display, New Delhi, Oct. 8-12, 2006, pp. 511-514.

Gao, et al., "Nanowire Piezoelectric Nanogenerators on Plastic Substrates as Flexible Power Sources for Nanodevices", DOI: 10.1002/adma.200601162, Advanced Materials, Communication, Dec. 2006, pp. 1-6.

Extended European Search Report for EP Application No. 09836119.9 issued Jun. 14, 2012.

* cited by examiner

*Primary Examiner* — Nimeshkumar Patel
*Assistant Examiner* — Steven Horikoshi
(74) *Attorney, Agent, or Firm* — Harrington & Smith

(57) ABSTRACT

An example embodiment there is provided an electroluminescent device comprising: an electroluminescent component, a first piezoelectric component, an alpha electrode and a first beta electrode, the electroluminescent component being located between the alpha electrode and the first piezoelectric component, the first beta electrode being in electrical contact with the alpha electrode and in electrical contact with the first piezoelectric component, the alpha electrode, first beta electrode, first piezoelectric component, and electroluminescent component being configured to generate a potential difference across the electroluminescent component responsive to a mechanical stress applied to the first piezoelectric component.

24 Claims, 5 Drawing Sheets

ELECTROLUMINESCENT DEVICE HAVING PIEZOELECTRIC COMPONENT

TECHNICAL FIELD

The present application relates generally to electroluminescent devices.

BACKGROUND

Electroluminescence (EL) is a phenomenon where a material emits light in response to an electric voltage/current or in response to a strong electric field. EL is the result of radiative recombination of electrons and holes in a material (usually a semiconductor).

Excited electrons release their energy as photons, for example visible light. Prior to recombination, electrons and holes are separated either as a result of doping of the material to form a p-n junction (in semiconductor electroluminescent devices such as LEDs), or through excitation by impact of high-energy electrons accelerated by a strong electric field (as with the phosphors in electroluminescent displays).

There have been a number of recent developments in electroluminescent (EL) devices for use in light emissive displays, including the use of organic polymers. EL devices containing an organic polymer generally have the following configuration: anode/organic polymer/EL material/cathode. The anode is typically any material that has the ability to inject holes into the EL material, such as, for example, indium/tin oxide (ITO). Optionally, the anode may be supported on a glass or plastic substrate. EL materials include, for example, fluorescent dyes, fluorescent and phosphorescent metal complexes, conjugated polymers, and mixtures thereof. The cathode is typically any material, such as Calcium (Ca) or Barium (Ba), that has the ability to inject electrons into the EL material. The organic polymer is typically a conductive organic polymer which facilitates the injection of holes from the anode into the EL polymer component. Stress-induced light emitting materials emit light in response to application of a mechanical stress.

SUMMARY

Various aspects of the invention are set out in the claims.

According to a first aspect of the present invention there is provided an electroluminescent device comprising: an electroluminescent component, a first piezoelectric component, an alpha electrode and a first beta electrode, the electroluminescent component being located between the alpha electrode and the first piezoelectric component, the first beta electrode being in electrical contact with the alpha electrode and in electrical contact with the first piezoelectric component, the alpha electrode, first beta electrode, first piezoelectric component, and electroluminescent component being configured to generate a potential difference across the electroluminescent component responsive to a mechanical stress applied to the first piezoelectric component.

According to a second aspect of the present invention there is provided a method comprising: locating an electroluminescent component between an alpha electrode and a first piezoelectric component, electrically contacting a first beta electrode to the alpha electrode, electrically contacting the first beta electrode to the piezoelectric component; and configuring the alpha electrode, first beta electrode, first piezoelectric component, and electroluminescent component such that a mechanical stress applied to the first piezoelectric component generates a potential difference across the electroluminescent component.

BRIEF DESCRIPTION OF THE DRAWINGS

For a more complete understanding of example embodiments of the present invention, reference is now made to the following description taken in connection with the accompanying drawings in which.

DETAILED DESCRIPTION OF THE DRAWINGS

Example embodiments of the present invention and their potential advantages are best understood by referring to FIGS. 1*a* through 3*c* of the drawings.

Figure 1A:
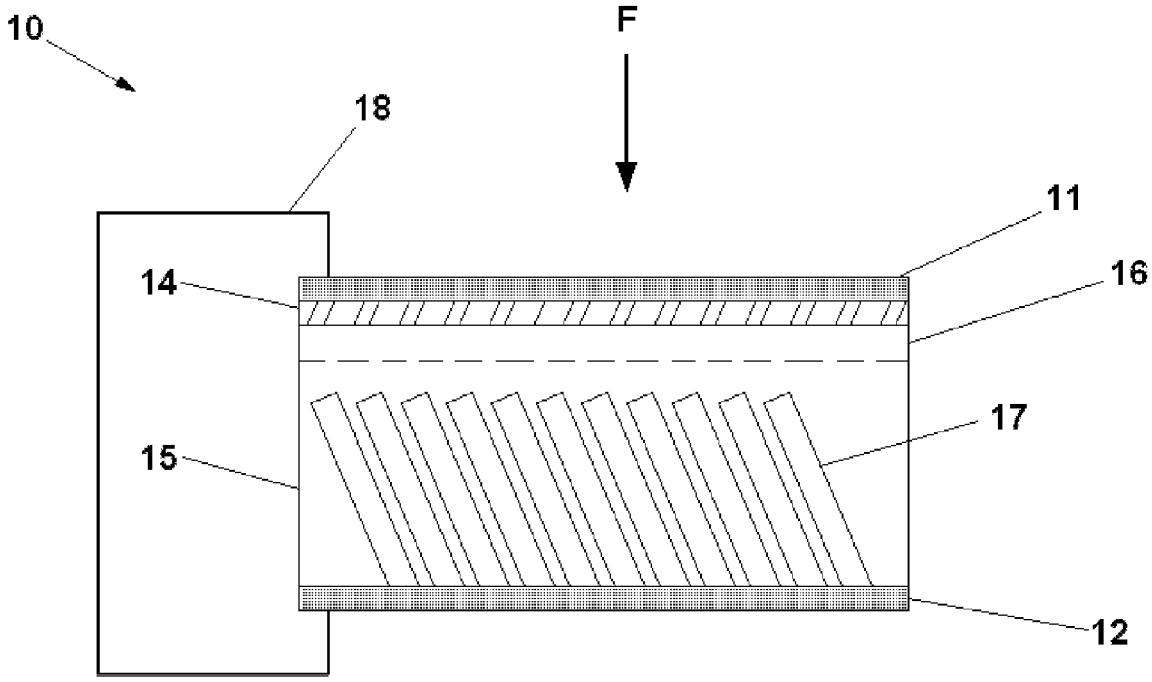
FIG. 1*a* is a schematic diagram of an electroluminescent device in accordance with an example embodiment of the present invention.

FIG. 1*a* shows a schematic diagram of an electroluminescent device 10 in accordance with an example embodiment of the present invention. The electroluminescent device 10 comprises two electrodes, a first, or "alpha" electrode 11, and a second, or "beta" electrode 12, between which is located an electroluminescent component 14, a piezoelectric component 15, and a dielectric component 16. In the example embodiment of FIG. 1*a*, the beta electrode 12 is in electrical contact with the piezoelectric component 15, and the beta electrode 12 is also electrically connected to the alpha electrode 11 by electrical connection 18, so that the alpha electrode 11 is, at steady state, maintained at substantially the same potential as the beta electrode. The electroluminescent component 14 is located between the alpha electrode 11 and the piezoelectric component 15. In the illustrated embodiment, dielectric component 16 is located between the piezoelectric component 15 and the electroluminescent component 14. In alternative embodiments, dielectric component 16 may be omitted.

In the example embodiment of FIG. 1*a*, the alpha electrode 11, beta electrode 12, dielectric component 16, electroluminescent component 14, and piezoelectric component 15 are configured to form a layered structure. A component of force applied in the direction of arrow F, causing pressure to be applied to layered structure, may cause a mechanical stress to be applied to the piezoelectric component. Mechanical stress applied to the piezoelectric component 15 may generate a potential difference between part of the piezoelectric component 15 and the alpha electrode 11. The applied mechanical stress may also give rise to a small transient potential difference between the alpha 11 and beta 12 electrodes. The electric field associated with the potential difference between part of the piezoelectric component 15 and the alpha electrode 11 may cause the electroluminescent component 14 to emit electromagnetic radiation, for example visible light.

In the illustrated embodiment, the piezoelectric component 15 comprises a multiplicity of piezoelectric particles 17. In FIG. 1*a*, each piezoelectric particle is in direct contact with the beta electrode 12, and is therefore referred to as a contact piezoelectric particle. In other example embodiments, it is possible that not all the piezoelectric particles present in the piezoelectric component are in direct contact with the beta electrode, in which case only some of the piezoelectric particles are contact piezoelectric particles.

Figure 1B:
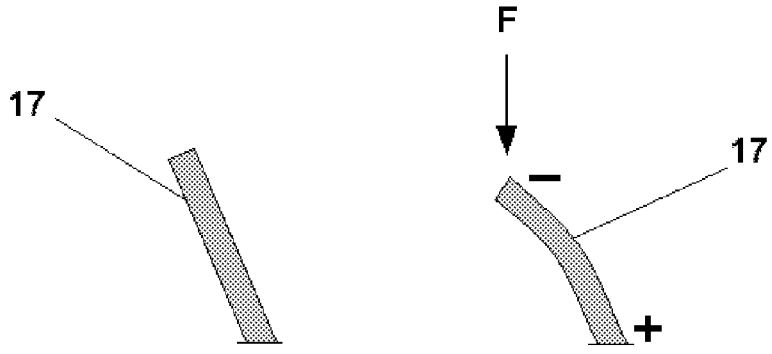
FIG. 1*b* is a schematic diagram of a piezoelectric particle that forms part of the electroluminescent device illustrated in FIG. 1*a;*

When a mechanical stress is applied to the piezoelectric component 15, for example as a result of a force F being applied to the surface of alpha electrode 11, an electric dipole may, at least transiently, be generated in at least some of the piezoelectric particles 17. The mechanical stress applied to the piezoelectric component 15 may cause deformation of the piezoelectric particles at the microscopic level. This process is shown in FIG. 1*b*, which shows a piezoelectric particle 17 that is in a deformed state on the right side of the figure, and undeformed on the left. The deformation results in generation of an electric dipole, or electric charge separation, at least transiently, across the piezoelectric particle. In the illustrated example, one end of each piezoelectric particle 17 is electrically connected to the beta electrode 12. Therefore the dipole causes a corresponding transient potential difference to be applied across the electroluminescent component 14, which is located between the alpha and beta electrodes 11 and 12. The application of a potential difference across the electroluminescent component may cause it to electroluminesce, so that electromagnetic radiation, for example visible light, is emitted. The alpha electrode 11 may comprise a material that transmits light, so that application of pressure to the alpha electrode 11 may cause light to be emitted through the electrode 11.

Figure 1C:
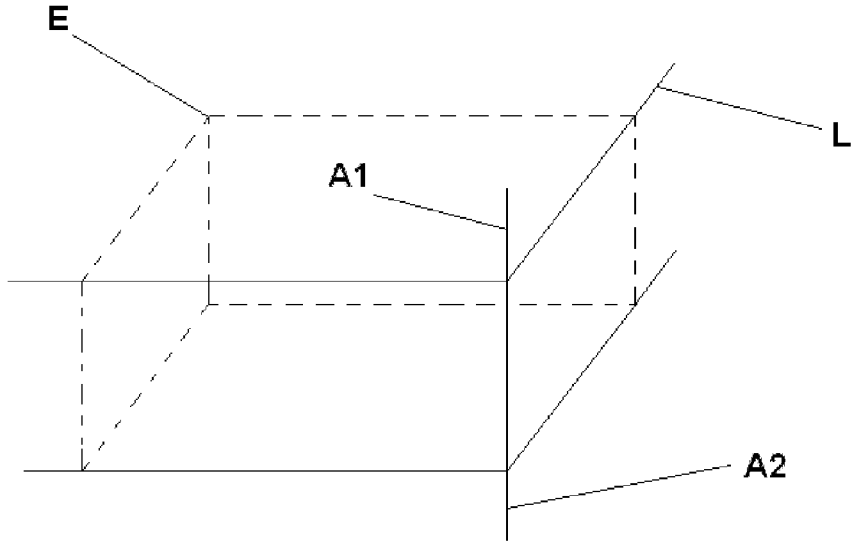
FIG. 1*c* is a schematic diagram of a sub-element of that forms part of the electroluminescent device of FIG. 1*a;*

FIG. 1*c* shows an element E that forms part of the electroluminescent device 10 of FIG. 1*a*. In the figure, the sub-element E may represent one of: the alpha electrode 11, the beta electrode 12, the electroluminescent component 14, the piezoelectric component 15, and the dielectric component 16. The sub-element E may form part of a larger element L. For example if the sub-element is the alpha electrode, or a beta electrode, the larger element L may comprise a larger electrode. The larger electrode may comprise a mesh, it may comprise a porous layer, or it may comprise a layer of electrically connected sub-electrodes. The larger element may be planar, it may be a layer, and may have one or more curved surfaces. When the sub-element E is located in the electroluminescent device 10 it may have an adjacent elements A1, when the sub-element E is located in the electroluminescent device it may have an adjacent element A2. For example if the sub element is the electroluminescent component 14, then A1 is the alpha electrode 11, and A2 is the dielectric component 16.

The piezoelectric particles may comprise piezoelectric nanoparticles, or piezoelectric microparticles. The piezoelectric nanoparticles may comprise one or more of: nanofilaments, nanowires, or nanotubes. The piezoelectric particles may comprise nanoparticles that are substantially aligned in a single direction. The alignment of the nanoparticles may facilitate the generation of a sufficient dipole (and hence a sufficient electric field), when the force is applied, to cause electroluminescence from the electroluminescent component 14. Electroluminescence may result from charge having one sign being present on the alpha electrode 11, and charge having an opposite sign being present on the piezoelectric component 15. The polarity of the potential difference across the electroluminescent component 14 may be influenced by the alignment of the piezoelectric nanoparticle and/or choice of materials.

The nanoparticles may be aligned so that their longitudinal axes form a predetermined angle or range of angles with respect to the local surface of the of the beta electrode. Alternatively, the nanoparticles may be aligned so that their longitudinal axes form a predetermined angle or range of angles with respect to the local normal to the beta electrode. In embodiments of the invention, the nanoparticles may be aligned so that the longitudinal axis of each aligned nanoparticles is between 2 degrees and 20 degrees from a normal to the beta electrode. In alternative embodiments, the nanoparticles may be aligned so that the longitudinal axis of each aligned nanoparticles is between 5 degrees and 85 degrees from a normal to the beta electrode. This angle relative to the normal, may also facilitate generation of a dipole.

The piezoelectric particles may comprise zinc oxide (ZnO). For example, the piezoelectric nanoparticles may comprise zinc oxide nanowires. Aligned zinc oxide nanowires may be grown using the technique described by L. Vayssieres, Adv. Mater. 2003, vol. 15, p. 464, which is incorporated by reference herein in its entirety. According to Vayssieres, a gold electrode can be fabricated by thermal evaporation on a dielectric component, such as a kapton polyimide plastic layer. The electrode is then suspended in a glass container containing a mixture of equal volumes of a aqueous solution of $Zn(NO_3)_2 6H_2 0$ (zinc nitrate hexahydrate) (at 0.01-0.04M molar concentration) and hexamethylenetetramine (at 0.01-0.04M molar concentration) at a temperature between 60 and 80° C. After reaction the ZnO nanowire array that has been deposited on the electrode is removed from the solution, rinsed with deionized water, and dried at 60 and 80° C. for twelve hours.

The dielectric component 16 may be, at least partly, formed from a resiliently flexible material such as polystyrene or poly(isoprene). The dielectric component 16 may comprise flexible non-conducting polymers having a glass transition temperature below the operating temperature of the device. The dielectric component 16 may comprise a silicone rubber such as poly(dimethylsiloxane) (PDMS). The silicone rubber may be applied to the piezoelectric component 15 by spin casting, followed by curing.

The piezoelectric component 15 may comprise a resiliently flexible dielectric material. The flexibility of the dielectric material may facilitate deformation of the piezoelectric nanoparticles, in response to the application of force, and facilitate the generation of a dipole. The dipole may comprise a surface charge. In embodiments of the invention, the surface charge may be between 5 and 100 pC/N (pico Coulombs per Newton). In alternative embodiments, the surface charge may be between 10 and 40 pC/N.

The beta electrode 12 may comprise a metallic conductor such as a gold. The electroluminescent component 14 may comprise one or more of: tailored quantum dot materials (for example, zinc sulphide (ZnS) mixed with manganese (Mn) and III-V semiconductors such as indium phosphide (InP), gallium Arsenide (GaAa) or gallium nitride (GaN), and organic semiconductors, for example (Ru(bipyridine)($PF_6$) (ruthenium bipyridine phosphorus hexafluoride). The electroluminescent component 14 may comprise semiconductor quantum dots having a largest dimension between 0.1 nm and 50 nm. The electroluminescent component may comprise semiconductor quantum dots having a largest dimension between 1 nm and 20 nm. The electroluminescent component 14 may comprise one or more of: organic conjugated polymers, PPV (poly(p-phenylene-vinylene)), poly-9,9-dioctylfluorene, and PFO (poly(9,9-dioctylfluorene)).

In alternative embodiments, electroluminescent component 14 may comprise a phosphorescent material comprising one or more of: ZnS, an inorganic phosphor, an organometallic complex, and copper-activated ZnS. The organometallic complex may comprise a complex of one or more of: osmium (Os), ruthenium (Ru), iridium (Ir), and platinum (Pt). In alternative embodiments, a separate phosphorescent layer may be provided, for example between the electroluminescent component 14 and the alpha electrode 11 or the alpha electrode may comprise a phosphorescent material.

The presence of the phosphorescent material may cause the duration of illumination to increase relative to that where only an electroluminescent material is present in the electroluminescent component 14. For example the presence of a phosphorescent material may result in the surface of the electroluminescent component 14 to emit light for several seconds after it has been touched.

The alpha electrode 11 may comprise indium/tin oxide (ITO) nanoparticles having a mean largest dimension of between 10 nm and 50 nm. The alpha electrode may comprise carbon nano tubes. The alpha electrode 11 may comprise a material that transmits or is transparent to visible radiation. The alpha electrode 11 may comprise pores that are configured to allow transmission of radiation from the electroluminescent component 14. The electroluminescent material may be deposited on the surface of the dielectric component 16 by spin coating, or by evaporation.

Figure 2:
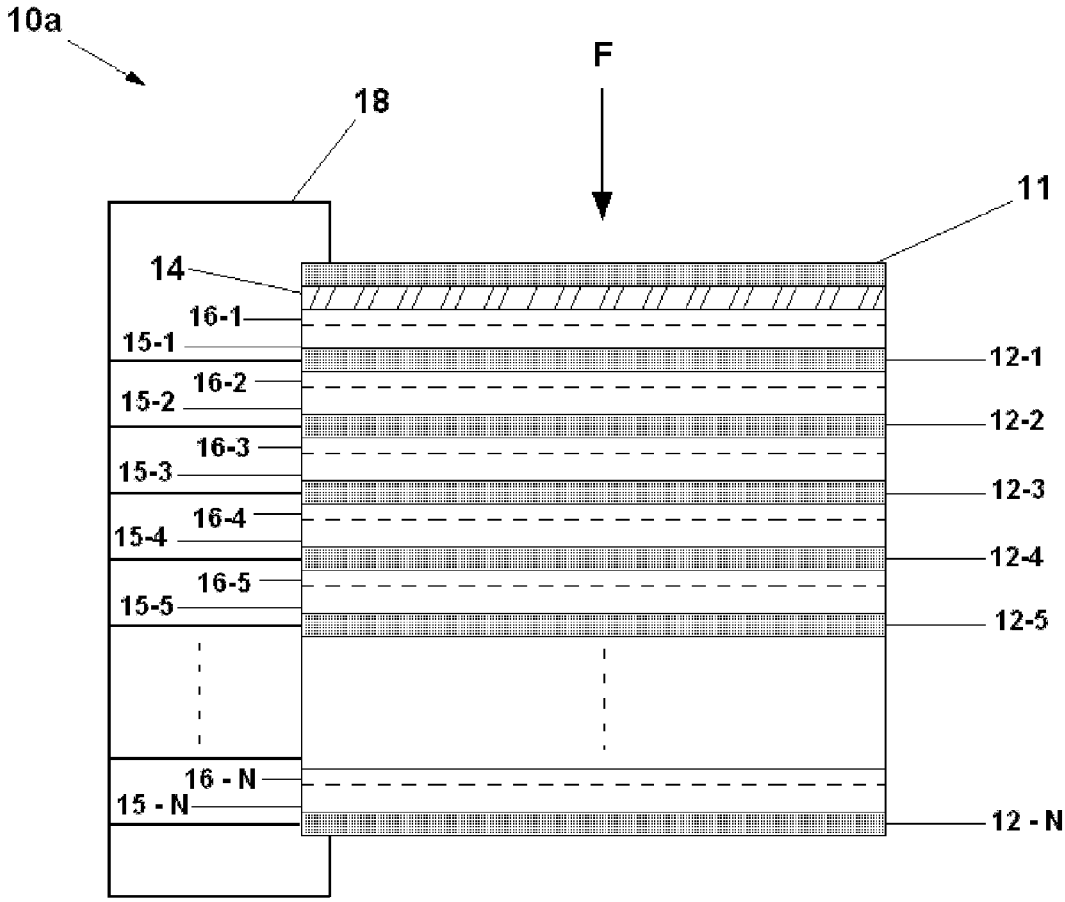
FIG. 2 is a schematic diagram of an electroluminescent device in accordance with a further example embodiment of the present invention.

FIG. 2 shows a schematic diagram of an electroluminescent device 10*a* in accordance with a further example embodiment of the present invention. The electroluminescent device 10*a* comprises a layered structure comprising an electroluminescent component 14, an alpha electrode 11, a first beta electrode 12-1, a first piezoelectric component 15-1, and a first dielectric component 16-1. The electroluminescent component 14, first piezoelectric component 15-1 and first dielectric component 16-1 are located between the alpha electrode 11 and the first beta electrode 12-1. Their physical and electrical arrangement is as described in connection with FIG. 1*a*. Additionally, the electroluminescent device 10*a* of FIG. 2 comprises a second beta electrode 12-2. A second piezoelectric component 15-2, and a second dielectric component 16-2 are located between the second beta electrode 12-2 and the first beta electrode 12-1. In this example, the second beta electrode 12-2 is electrically connected to the second piezoelectric component 15-2 and the second dielectric component 16-2 is located between the second piezoelectric component 15-2 and the first beta electrode 12-1. The second beta electrode 12-2 is electrically connected to the first beta electrode 12-1 and to the alpha electrode 11 via electrical connection 18 such that they are, at steady state, maintained at substantially the same electrical potential.

The alpha electrode 11, first and second beta electrodes 12-1, 12-2, first and second piezoelectric components 15-1, 15-2, first and second dielectric components 16-1, 16-2, and electroluminescent component 14 are configured such that a mechanical stress applied to the layered structure comprising the first and second piezoelectric components 15-1, 15-2, generates a potential difference across the electroluminescent component 14.

In this example, as in FIG. 1*a*, the piezoelectric components 15-1, 15-2 comprise a multiplicity of piezoelectric particles (not shown in FIG. 2), some or all of which are contact piezoelectric particles, as defined in connection with FIG. 1*a*. When a force F is applied to the device, for example as indicated by the arrow in FIG. 2, a dipole may, at least transiently, be generated in piezoelectric particles located in the first and/or second piezoelectric components 15-1, 15-2. One end of each contact piezoelectric particle in the first piezoelectric component 15-1 is electrically connected to the first beta electrode 12-1. Similarly, one end of each contact piezoelectric particle in the second piezoelectric component 15-2 is electrically connected to the second beta electrode 12-2. The electric dipoles generated in the piezoelectric particles of the first and second piezoelectric components 15-1,15-2 cause a potential difference to be applied across the electroluminescent component 14. The application of a potential difference across the electroluminescent component may cause it to electroluminesce, so that electromagnetic radiation, for example visible light, is emitted.

Provision of a second piezoelectric component 15-2, together with an associated second beta electrode 12-2, and second dielectric component 16-2, may allow a greater potential difference to be generated across the electroluminescent component 14, relative to the device of FIG. 1*a*, and allow a higher intensity of light to be generated.

The electroluminescent device shown in FIG. 2 may be provided with a plurality of beta electrodes 12-1 to 12-N, a plurality of dielectric components 16-1 to 16-N, and a plurality of piezoelectric component 15-1 to 15-N. The plurality of beta electrodes 12-1 to 12-N, plurality of dielectric components 16-1 to 16-N and plurality of piezoelectric components 15-1 to 15-N may be disposed, for example, in an ordered layered structure, as illustrated in FIG. 2. Each of the plurality of beta electrodes 12-1 to 12-N is in electrical contact with the alpha electrode 11, so that the alpha electrode 11 is maintained at substantially the same potential as each of the plurality of beta electrodes 12*b*. Each piezoelectric component 15-1 to 15-N may comprise a multiplicity of piezoelectric particles, (not shown in FIG. 2), as described in connection with FIG. 1*a*. Alteration of the number N of piezoelectric components 15-1 to 15-N and the associated components, which form part of the electroluminescent device, may allow the size of the transient potential difference generated across the electroluminescent layer to be controlled. The size of the transient potential difference may determine the intensity of emitted electromagnetic radiation, e.g. visible light. The composition and construction of components 11, 12-1 to 12-N, 14, 15-1 to 15-N, and 16-1 to 16-N illustrated in FIG. 2 may be substantially the same as the components of FIG. 1*a* that have corresponding reference numbers. As in the embodiment of FIG. 1, in some embodiments any one, or combination of dielectric components 16-1 to 16-N may be omitted. In one embodiment of the device 10*a*, no dielectric components 16-1 to 16-N are present.

An electroluminescent device 10, as described in connection with FIGS. 1*a*-1*c*, or an electroluminescent device 10*a*, as described in connection with FIG. 2, may be incorporated into any device where illumination is desired, for example a device that is dependent on low power consumption. Alternatively, the electroluminescent device of FIG. 1*a* or FIG. 2 may be incorporated into a device that has no power supply of its own, but where illumination of the device or certain parts of the device may be desirable. An electroluminescent device according to an embodiment of the invention may be incorporated into devices such as lamps and torches, which may be brought into a state of illumination by applying a mechanical force; it may be incorporated into the tire of a vehicle, which may be brought into a state of illumination by the forces generated when the vehicle is being driven; it may be incorporated into a touch screen, which may be brought into a state of illumination by applying pressure to at least a part of the screen; it may be incorporated into the housing of a portable electronic device, such as a mobile telephone, a laptop computer, a portable music player, a portable games console and/or the like, the housing being brought into a state of illumination by applying pressure to at least a part of its surface. An electroluminescent device according to an embodiment of the invention may also be incorporated, for example, into a loudspeaker where it may be brought into a state of illumination e.g. by a mechanical stress caused by vibration of the loudspeaker's cone.

Figure 3A:
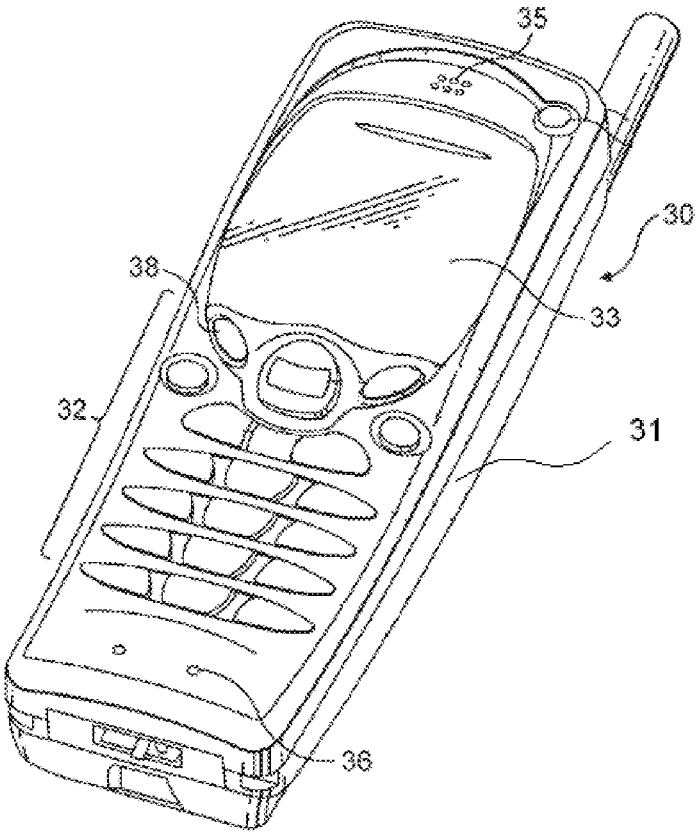
FIG. 3*a* is a schematic diagram of an electronic device comprising an electroluminescent device as illustrated in FIG. 2, in accordance with a further example embodiment of the present invention.

FIG. 3*a* is a schematic diagram of an electronic device comprising an electroluminescent device as illustrated in FIG. 2. In FIG. 3*a*, electronic device 30 is a mobile communication device, for example a mobile telephone, that comprises a housing 31, a piezoelectric key 38, a display 33, a loudspeaker 35, a microphone 36, and a keypad 32 comprising a plurality of keys, the piezoelectric key 38 comprising an electroluminescent device according to the embodiment of FIG. 2. It should be appreciated that in other embodiments electronic device 30 may be any electronic device comprising a key, keypad, keyboard or any other arrangement of keys, push-buttons or touch-sensitive regions in which a piezoelectric device according to an embodiment of the present invention is incorporated into any one or any combination of the keys.

Figure 3B:
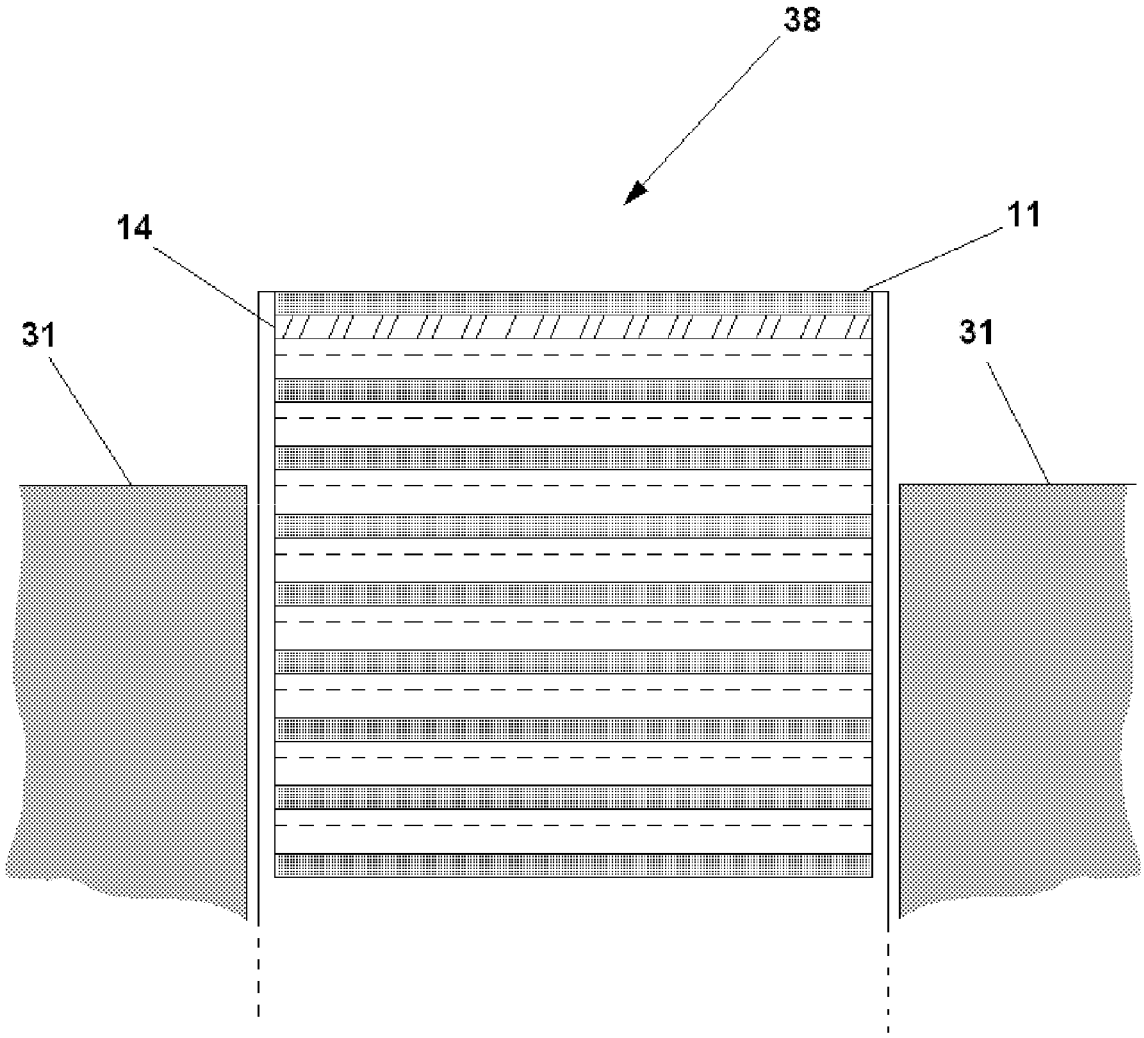
FIG. 3*b* is a schematic diagram of part of the electronic device shown in FIG. 3*a* in accordance with a further example embodiment of the present invention.

FIG. 3*b* shows a cross-section through the piezoelectric key 38 of mobile communication device 30. It shows alpha electrode 11, electroluminescent component 14, piezoelectric components 15-1 to 15-N and dielectric components 16-1 to 16-N, in relation to electronic device housing 31. A user of the electronic device may press the key 38, so that a finger of the user applies pressure to alpha electrode 11. This pressure may cause a mechanical stress to be applied to one or more of the piezoelectric components 15-1 to 15-N. This may cause a potential difference to be applied across the electroluminescent component 14, and may cause light to be emitted from the component. In alternative embodiments, electronic device may comprise more than one piezoelectric key. Alternatively, or additionally, display 33 may be combined with a touch screen comprising an electroluminescent device according to the embodiment of FIG. 1*a* or FIG. 2. In other embodiments, a separate electroluminescent touch pad may be provided. In still other embodiments, the housing 31 or a part of the housing may comprise an electroluminescent device according to the embodiment of FIG. 1*a* or FIG. 2.

Figure 3C:
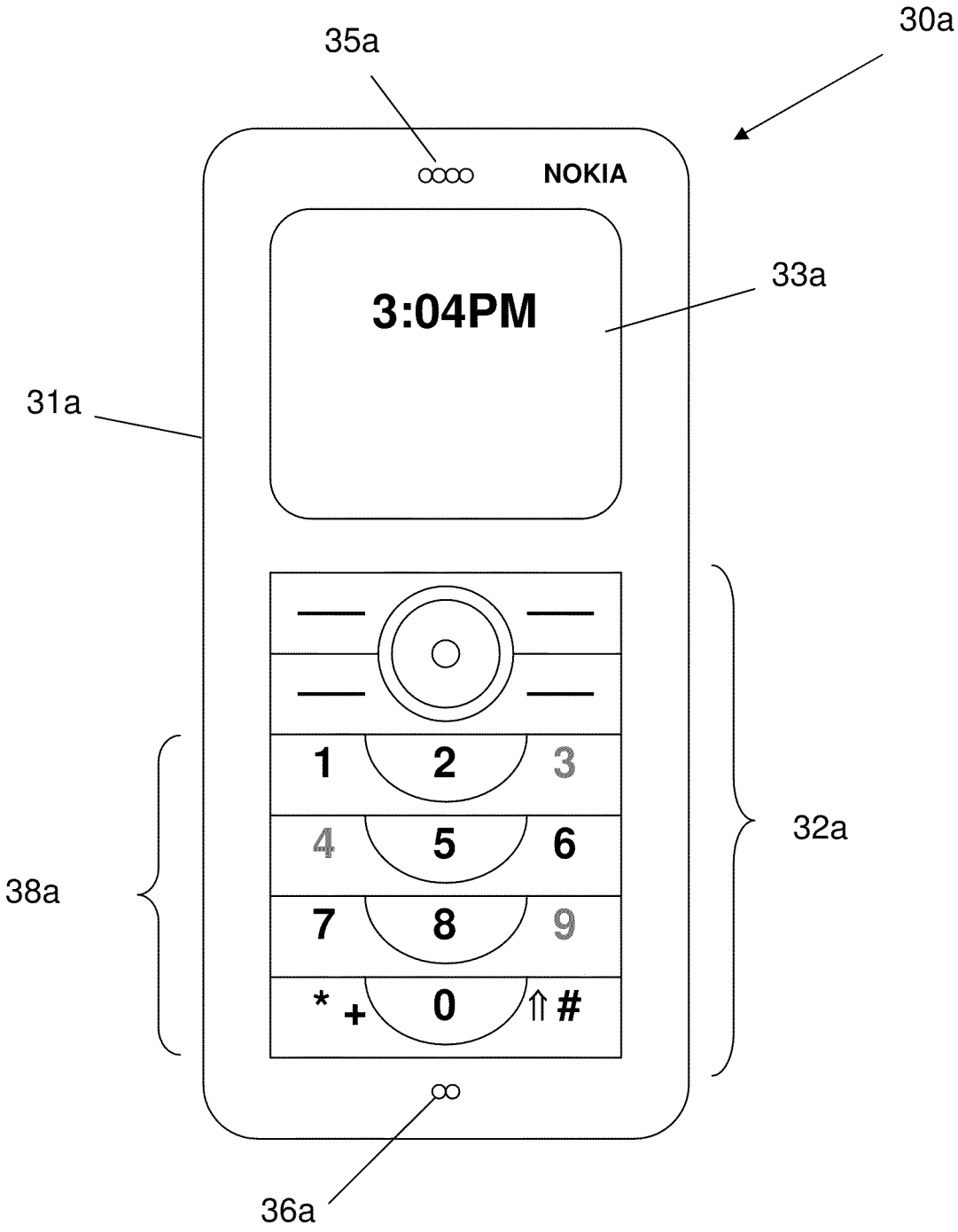
FIG. 3*c* is a schematic diagram illustrating operation of an electronic device according to a further example embodiment of the invention.

FIG. 3*c* is a schematic diagram illustrating operation of an electronic device according to a further example embodiment of the invention. As in FIG. 3*a*, the electronic device 30*a* illustrated in FIG. 3*c* is a mobile communication device, for example a mobile telephone, comprising a housing 31*a*, a display 33*a*, a loudspeaker 35*a*, a microphone 36*a*, and a keypad 32*a* comprising a plurality of keys. In the example embodiment of FIG. 3*c*, a subset 38*a* of the keys that make up the keypad 32*a* are piezoelectric keys, each comprising a piezoelectric device 10, 10*a*, as described, for example, in connection with FIGS. 1*a*-1*c* or FIG. 2. In the illustrated embodiment, the subset of keys comprises the numeric keys used for dialing telephone numbers. In alternative embodiments, a different subset of keys may be piezoelectric keys, or alternatively, all keys of keypad 32*a* may be equipped with a piezoelectric device 10, 10*a*. As is well known to the skilled person in mobile telecommunications, the numeric keys of a mobile communication device, e.g. a mobile telephone, may also be used to enter other textual characters, for example letters of the Latin alphabet or Chinese Kanji characters, in order to compose a Short Message Service (SMS) message.

In FIG. 3*c*, it is assumed that a user of the mobile communication device is in the process of dialing a telephone number in order to initiate a telephone call with a receiving party. The telephone number to be dialed starts with the numbers 3, 4 & 9 and, in the figure, the mobile communication device is illustrated at a point in time shortly after the user has dialed the number 9, the third number in the sequence. As each of the numeric keys making up subset 38*a* comprises a piezoelectric device 10, 10*a*, each press or actuation of a numeric key during number dialing results in electroluminescence causing e.g. visible light to be emitted from the key in question. In the illustrated embodiment, the surface of each numeric key is formed by an element that is transparent to visible light, at least part of the transparent element forming the alpha electrode 11 of a piezoelectric device 10, 10*a* incorporated in the key. This arrangement allows visible light generated by electroluminescence within the piezoelectric key to be emitted from the surface of the key. Each key is provided with a corresponding number, or a number and one or more other characters in the case of keys having character entry functionality in addition to number dialing functionality. The number and/or character(s) may be etched or inlayed into the surface of the key, painted or printed on the key, formed as a raised protrusion, or provided in any other way that enables the labeling of the key to be identified by the user of the mobile communication device. It may be desirable to inlay the number/character(s) in the key or print the number/character(s) on the key using a material that is substantially opaque to visible light. This may have the technical effect of enhancing the contrast of the number or character(s) when illuminated, thereby improving its visibility to the user. Alternatively, the surface of each key may be coated with an opaque mask having a cut-out in the form of the number or character to be applied to the key. In this embodiment, the number or character itself is illuminated by electroluminescence of the piezoelectric key and light is prevented from escaping from the remaining surface of the key. In still other embodiments, the piezoelectric device incorporated into each key may be formed in the shape of the number/character(s) carried by the key, pressure applied to the key causing illumination of the embedded number or character(s).

Returning to consideration of FIG. 3*c*, it will be appreciated that the intensity of light emitted by each key when it is pressed decays once the pressure applied to the key is removed. After a key is pressed, therefore, the key initially glows comparatively brightly and then becomes progressively dimmer. After a certain period of time, electroluminescence ceases and the key ceases to be illuminated. As explained in connection with FIG. 1*a*, the persistence of electroluminescence may be enhanced by incorporating a phosphorescent material into an electroluminescent device. This may have the technical effect of prolonging the time for which visible light is produced. It was also noted in connection with FIG. 2, that the intensity of light produced by an electroluminescent device may be enhanced by providing a greater number of piezoelectric components e.g. in a layered configuration, with their corresponding beta electrodes connected together. Thus, in the communication device depicted in FIG. 3*c*, the structure of the piezoelectric keys 38*a* may be tailored to provide a certain brightness of illumination when a key is pressed and a certain persistence of illumination after pressing.

In the example of FIG. 3*c*, where a telephone number to be dialed starts with the numbers 3, 4 and 9, the number 9 was dialed most recently. At an instant shortly after the number 9 key is pressed, that key is illuminated most brightly. Due to the persistence of the electroluminescent effect in the other keys, the number 4 key, which was pressed one key press earlier is still illuminated, but less brightly than the number 9 key. Similarly, the number 3 key, pressed two key presses ago is still illuminated, but its illumination has decayed to a greater extent. In FIG. 3*c*, this effect is represented by the circles of different diameters drawn in dotted lines surrounding the keys pressed so far.

Providing illuminating piezoelectric dialing keys with a certain degree of persistence may have the technical effect of providing a user with a memory aid concerning e.g. the numbers of a telephone number already dialed. The use of such keys may also assist visually impaired users when dialing telephone numbers, or writing SMS messages for example.

In embodiments of the invention, a numeric keypad or keypad for combined numerical/text input (e.g. an alphanumeric keypad) may be provided with illuminating piezoelectric keys in combination with, or as a replacement for, conventional illumination e.g. in the form of light emitting diodes (LEDs). This may have the technical effect of reducing power consumption and may result in a commensurate increase in battery lifetime. Although illustrated in the context of a mobile communication device such as a mobile telephone, it should be appreciated that a keypad comprising illuminating piezoelectric keys providing a degree of persistent illumination, as described in connection with FIG. 3*c*, may be provided in any device comprising a keypad, keyboard, touch pad or touch screen. Illuminating piezoelectric keys with a certain degree of persistence may also be provided for example in keyboards suitable for connection to computer devices, or in the keyboards of musical instruments.

Without in any way limiting the scope, interpretation, or application of the claims appearing below, it is possible that a technical effect of one or more of the example embodiments disclosed herein may be generation of electroluminescence by the application of a potential difference generated, by deformation of aligned piezoelectric particles, across an electroluminescent component. Another possible technical effect of one or more of the example embodiments disclosed herein may be generation of electroluminescence by the application of a potential difference generated by deformation of aligned piezoelectric particles, the application comprising arranging the electroluminescent component between an alpha electrode and a beta electrode. Another technical effect of one or more of the example embodiments disclosed herein may be generation of electroluminescence by the application of a potential difference generated by deformation of aligned piezoelectric particles, the application comprising arranging the electroluminescent component between an alpha electrode and a beta electrode, at least some of the piezoelectric particles being in contact with the beta electrode. Another technical effect of one or more of the example embodiments disclosed herein may be generation of electroluminescence by the application of a potential difference generated by deformation of aligned piezoelectric particles, the application comprising arranging the electroluminescent component between an alpha electrode and a beta electrode, at least some of the piezoelectric particles being in contact with the beta electrode, a resiliently flexible dielectric component being disposed between at least some of the piezoelectric particles and the alpha electrode. Another technical effect of one or more of the example embodiments disclosed herein may be the generation of electromagnetic radiation from a device that is not configured to generate significant amounts of electrical power.

Although various aspects of the invention are set out in the independent claims, other aspects of the invention comprise any combination of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An electroluminescent device comprising:

an electroluminescent component, a first piezoelectric component, an alpha electrode and a first beta electrode, the electroluminescent component being located between the alpha electrode and the first piezoelectric component, the first beta electrode being in electrical contact with the alpha electrode and in electrical contact with the first piezoelectric component, wherein the alpha electrode, first beta electrode, first piezoelectric component, and electroluminescent component are configured to generate a potential difference across the electroluminescent component responsive to a mechanical stress applied to the first piezoelectric component, and further comprising:

a second piezoelectric component, and a second beta electrode that is in electrical contact with the alpha electrode and in electrical contact with the second piezoelectric component, the electroluminescent component being located between the alpha electrode and the second piezoelectric component, wherein the electroluminescent component, the alpha electrode, the second beta electrode, and the second piezoelectric component are configured to generate a potential difference across the electroluminescent component responsive to a mechanical stress applied to the second piezoelectric component and wherein the second beta electrode is located between the alpha electrode and the first beta electrode.

2. An electroluminescent device according to claim 1, wherein the electroluminescent device comprises more than one second beta electrodes, and more than one second piezoelectric components.

3. An electroluminescent device according to claim 2, wherein any one of the first piezoelectric component, or respectively any one or any combination of the first and second piezoelectric components comprises a multiplicity of piezoelectric particles.

4. An electroluminescent device according to claim 3, wherein any one of the first piezoelectric component, or respectively any one or any combination of the first and second piezoelectric components comprises a multiplicity of piezoelectric nanoparticles.

5. An electroluminescent device according to claim 2, wherein any one of the first piezoelectric component, or respectively any one or any combination of the first and second piezoelectric components comprises a multiplicity of contact piezoelectric particles, each contact piezoelectric particle being in electrical contact with a corresponding beta electrode.

6. An electroluminescent device according to claim 2, wherein any one of the first piezoelectric component, or respectively any one or any combination of the first and second piezoelectric components comprises a multiplicity of substantially aligned piezoelectric particles.

7. An electroluminescent device according to claim 2, wherein any one of the first piezoelectric component, or respectively any one or any combination of the first and second piezoelectric components comprises one or more of piezoelectric nanofilaments, piezoelectric nanotubes, or piezoelectric nanowires.

8. An electroluminescent device according to claim 1, wherein the electroluminescent component is located between the alpha electrode and the first beta electrode, and wherein the first piezoelectric component is located between the electroluminescent component and the first beta electrode.

9. An electroluminescent device according to claim 1, wherein the electroluminescent device further comprises a first dielectric component located between the alpha electrode and the first piezoelectric component.

10. An electroluminescent device according to claim 9, wherein the first dielectric component is located between the electroluminescent component and the first piezoelectric component.

11. An electroluminescent device according to claim 9, wherein the first dielectric component comprises a resiliently flexible dielectric material.

12. An electroluminescent device according to claim 9, wherein the electroluminescent device further comprises a plurality of dielectric components.

13. An electroluminescent device according to claim 1, wherein the first piezoelectric component comprises a resiliently flexible dielectric material.

14. An electroluminescent device according to claim 1, wherein the electroluminescent device further comprises a second dielectric component located between the alpha electrode and the second piezoelectric component.

15. An electroluminescent device according to claim 14, wherein the second dielectric component is located between the electroluminescent component and the second piezoelectric component.

16. An electroluminescent device according to claim 14, wherein the second dielectric component comprises a resiliently flexible dielectric material.

17. An electroluminescent device according to claim 14 wherein the first piezoelectric component comprises a resiliently flexible dielectric material.

18. An electroluminescent device according to claim 1, wherein the electroluminescent device further comprises a plurality of electroluminescent components, a plurality of alpha electrodes, a plurality of first beta electrodes.

19. An electroluminescent device according to claim 1, wherein the device comprises a plurality of second beta electrodes, and a plurality of second piezoelectric components.

20. An electroluminescent device according to claim 1, wherein the first piezoelectric component comprises a multiplicity of piezoelectric particles.

21. An electroluminescent device according to claim 20, wherein the first piezoelectric component comprises a multiplicity of piezoelectric nanoparticles.

22. An electroluminescent device according to claim 1, wherein the first piezoelectric component comprises a multiplicity of contact piezoelectric particles, each contact piezoelectric particle being in electrical contact with the first beta electrode.

23. An electroluminescent device according to claim 1, wherein the first piezoelectric component components comprises a multiplicity of substantially aligned piezoelectric particles.

24. An electroluminescent device according to claim 1, wherein the first piezoelectric component comprises one or more of piezoelectric nanofilaments, piezoelectric nanotubes, or piezoelectric nanowires.

* * * * *